US009636912B2

(12) United States Patent
Takagishi et al.

(10) Patent No.: US 9,636,912 B2
(45) Date of Patent: May 2, 2017

(54) INK JET RECORDING DEVICE

(71) Applicant: Hitachi Industrial Equipment Systems Co., Ltd., Chiyoda-ku, Tokyo (JP)

(72) Inventors: Tsuneaki Takagishi, Tokyo (JP); Nobuhiro Harada, Tokyo (JP); Manabu Kato, Tokyo (JP); Takashi Kawano, Tokyo (JP); Masato Ikegawa, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/780,320

(22) PCT Filed: Dec. 19, 2013

(86) PCT No.: PCT/JP2013/084135

§ 371 (c)(1),
(2) Date: Sep. 25, 2015

(87) PCT Pub. No.: WO2014/155872

PCT Pub. Date: Oct. 2, 2014

(65) Prior Publication Data

US 2016/0046124 A1 Feb. 18, 2016

(30) Foreign Application Priority Data

Mar. 28, 2013 (JP) ..... 2013-068889

(51) Int. Cl.
*B41J 2/06* (2006.01)
*B41J 2/075* (2006.01)
(Continued)

(52) U.S. Cl.
CPC ..... *B41J 2/06* (2013.01); *B41J 2/075* (2013.01); *B41J 2/08* (2013.01); *B41J 2/09* (2013.01); *B41J 2002/1853* (2013.01)

(58) Field of Classification Search
CPC ..... B41J 2/06; B41J 2/08; B41J 2/075; B41J 2002/1853
See application file for complete search history.

(56) References Cited

U.S. PATENT DOCUMENTS 4,491,852 A 1/1985 Jinnai
4,555,710 A * 11/1985 Koike ..... B41J 2/075 347/76

FOREIGN PATENT DOCUMENTS

JP 49-120541 A 11/1974
JP 55-114576 A 9/1980
(Continued)

OTHER PUBLICATIONS

International Search Report (PCT/ISA/210) issued in PCT Application No. PCT/JP2013/084135 dated Jan. 28, 2014 with English-language translation (four (4) pages).
(Continued)

*Primary Examiner* — Geoffrey Mruk
(74) *Attorney, Agent, or Firm* — Crowell & Moring LLP

(57) ABSTRACT

Under a condition in which bowed printing occurs, a horizontal shift is suppressed to improve print quality. Following a program stored in a ROM 12, an MPU 10 generates video data for charging print particles according to print contents data stored in a RAM 11. Based on the print contents data, the MPU 10 detects a letter to be printed last, and when the letter to be printed last is printed to end a print operation, generates video data so that based on the video data, a non-print charge voltage driving non-print particles to an extent that they do not fly over a gutter 25 is applied to non-print particles. The number of the non-print particles subjected to the non-print charge voltage is determined by the MPU 10, based on the distance from a print head 2 to a print subject 30, a letter height preset value, etc. A character signal generating circuit 18 generates the non-print charge
(Continued)

● : PRINTING PARTICLE
◍ : NON-PRINTING PARTICLE = WITH CHARGE AMOUNT voltage, based on the video data, and applies the generated the non-print charge voltage to a charging electrode 22.

11 Claims, 9 Drawing Sheets

(51) Int. Cl.

| | |
|---|---|
| ***B41J 2/08*** | (2006.01) |
| ***B41J 2/09*** | (2006.01) |
| *B41J 2/185* | (2006.01) |

(56) References Cited

FOREIGN PATENT DOCUMENTS

| | | | |
|---|---|---|---|
| JP | 59-16761 | A | 1/1984 |
| JP | 59-93358 | A | 5/1984 |
| JP | 8-118654 | A | 5/1996 |
| JP | 3218421 | B2 | 10/2001 |
| JP | 2002-1960 | A | 1/2002 |
| JP | 2008-137197 | A | 6/2008 |
| WO | WO 94/08792 | A1 | 4/1994 |
| WO | WO 02/090119 | A2 | 11/2002 |

OTHER PUBLICATIONS

Written Opinion (PCT/ISA/237) issued in PCT Application No. PCT/JP2013/084135 dated Jan. 28, 2014 with English-language translation (ten (10) pages).
European Search Report issued in counterpart European Application No. 13879748.5 dated Jan. 18, 2017 (nine pages).
Cover page of EP 1 390 207 A2 published Feb. 25, 2004 (one page).

* cited by examiner

● : PRINTING PARTICLE

○ : NON-PRINTING PARTICLE = WITHOUT CHARGE AMOUNT

INK JET RECORDING DEVICE

TECHNICAL FIELD

The present invention relates to an inkjet recording device and relates to, for example, a technique that can be applied to a charge-controlled ink jet recording device.

BACKGROUND ART

Japanese Laid-Open Patent Application Publication No. 2002-1960 (Patent Document 1) describes a technique by which an interval between consecutively arranged charged particles is widened without lowering a printing speed to reduce the effect of Coulomb repulsion of electric charges, thereby reducing print distortions.

Specifically, according to the technique, in an ink jet recording device that forms print characters out of dots of ink particles, vertically arranged dot data composed of columns of dots along the direction of deflection of ink particles is grasped column by column. Based on the vertically arranged dot data, with regard to dots of ink particles jet out of a nozzle for each column of dot data, the number of dots used for printing is calculated and whether any set of dots used for printing are charged consecutively is determined. When consecutively charged dots, that is, dots charged in succession, are present, a dot not used for printing that is included in the same column including the consecutively charged dots is interposed between the consecutively charged dots.

Another technique related to an ink jet recording device is also known that is to adjust timing of applying a charge voltage to ink particles, according to that technique, a charge voltage with a shifted phase is applied to non-printing particles and based on charge amount information of the non-printing particles to which such a charge voltage is applied, the optimum timing of efficiently charging ink particles is determined.

PRIOR ART DOCUMENT

Patent Document

Patent Document 1: Japanese Patent Application Laid-Open Publication No. 2002-1960

SUMMARY OF THE INVENTION

Problems to be Solved by the Invention

The ink jet recording device of the above-mentioned Patent Document 1 performs control such that, by effectively utilizing a non-printing particle, i.e., a particle not used for printing, an interval between consecutively arranged charged particles is widened without lowering a print speed to reduce the effect of Coulomb repulsion of electric charges, thereby reducing print distortions.

This technique is effective in reducing a vertical print distortion but its effectiveness in reducing a horizontal print distortion, such as curved printing or bowed printing, is not taken into consideration. According to the technique of Patent Document 1, therefore, when consecutively charged dots, i.e., dots charged in succession, are present and a dot not used for printing that is included in the same column including the consecutively charged dots is interposed between the consecutively charged dots, an unintentional change upon timing of applying the charging voltage results.

This causes an ink particle to land on a print subject at a time different from the original landing time, and the resulting landing time difference emerges as a horizontal shift, which is a problem.

A horizontal travel distance is given by an equation: landing time difference×travel speed of print subject=horizontal travel distance. This indicates that the control performed by the ink jet recording device of Patent Document 1 may increase a horizontal shift. When the print subject is transferred at high speed, in particular, the horizontal shift increases to a great extent.

The object of the present invention is to provide a technique by which under a condition in which bowed printing occurs, a horizontal shift is reduced to improve printing quality.

The above and other object and novel characteristics of the present invention will be apparent from the description of the present specification and the accompanying drawings.

Means for Solving the Problems

The typical summary of the inventions disclosed in the present application will be briefly described as follows.

A typical ink jet recording device includes a printing head and a printing control unit. The printing head has a nozzle that excites ink to jet it in the form of ink particles, a charging electrode that charges an ink particle, a deflector electrode that forms an electric field by which a charged ink particle is deflected, and a gutter that captures and reclaims an ink particle not used for printing.

The printing control unit controls a voltage applied to the charging electrode. The printing control unit causes the charging electrode to apply a charge voltage to a print particle, i.e., ink particle used for printing on a print subject and to apply a non-print charge voltage to a non-print particle, i.e., ink particle not used for printing on the print subject, the non-print charge voltage driving the non-print particle to an extent that it does not fly over the gutter and having a polarity identical with that of the print particle, thereby suppressing bowed printing during high-speed printing.

Effects of the Invention

The effects obtained by typical aspects of the present invention will be briefly described below.

(1) The quality irregularity of printing results can be reduced.

(2) The effect (1) allows an improvement in the precision of a printing inspection.

BRIEF DESCRIPTIONS OF THE DRAWINGS

DETAILED DESCRIPTION OF PREFERRED EMBODIMENTS

In the embodiments described below, the invention will be described in a plurality of sections or embodiments when required as a matter of convenience. However, these sections or embodiments are not irrelevant to each other unless otherwise stated, and the one relates to the entire or a part of the other as a modification example, details, or a supplementary explanation thereof.

Also, in the embodiments described below, when referring to the number of elements (including number of pieces, values, amount, range, and the like), the number of the elements is not limited to a specific number unless otherwise stated or except the case where the number is apparently limited to a specific number in principle. The number larger or smaller than the specified number is also applicable.

Further, in the embodiments described below, it goes without saying that the components (including element steps) are not always indispensable unless otherwise stated or except the case where the components are apparently indispensable in principle.

Similarly, in the embodiments described below, when the shape of the components, positional relation thereof, and the like are mentioned, the substantially approximate and similar shapes and the like are included therein unless otherwise stated or except the case where it is conceivable that they are apparently excluded in principle. The same goes for the numerical value and the range described above.

Also, the same components are denoted by the same reference symbols in principle throughout all the drawings for describing the embodiments, and the repetitive description thereof will be omitted. Note that hatching is used even in a plan view so as to make the drawings easy to see.

First Embodiment

Example of Configuration of Ink Jet Recording Device

Figure 1:
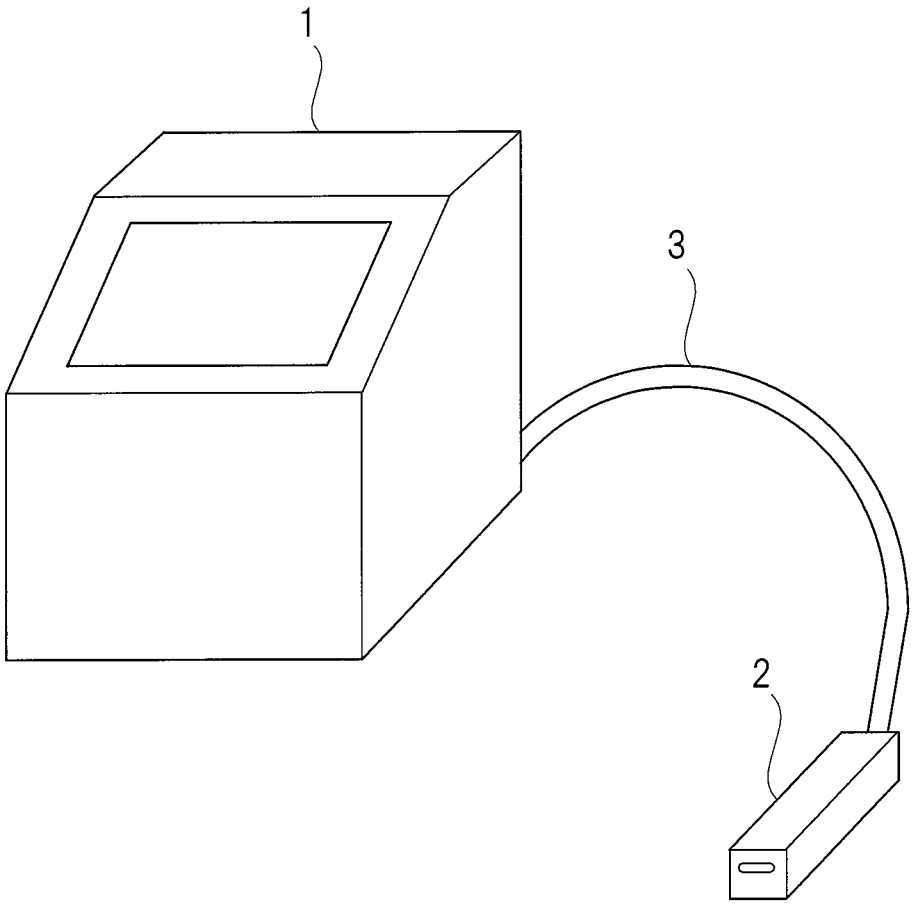
FIG. 1 is an explanatory diagram of an example of an ink jet recording device according to one embodiment of the present invention.

FIG. 1 is an explanatory diagram of an example of an ink jet recording device according to one embodiment of the present invention.

Figure 2:
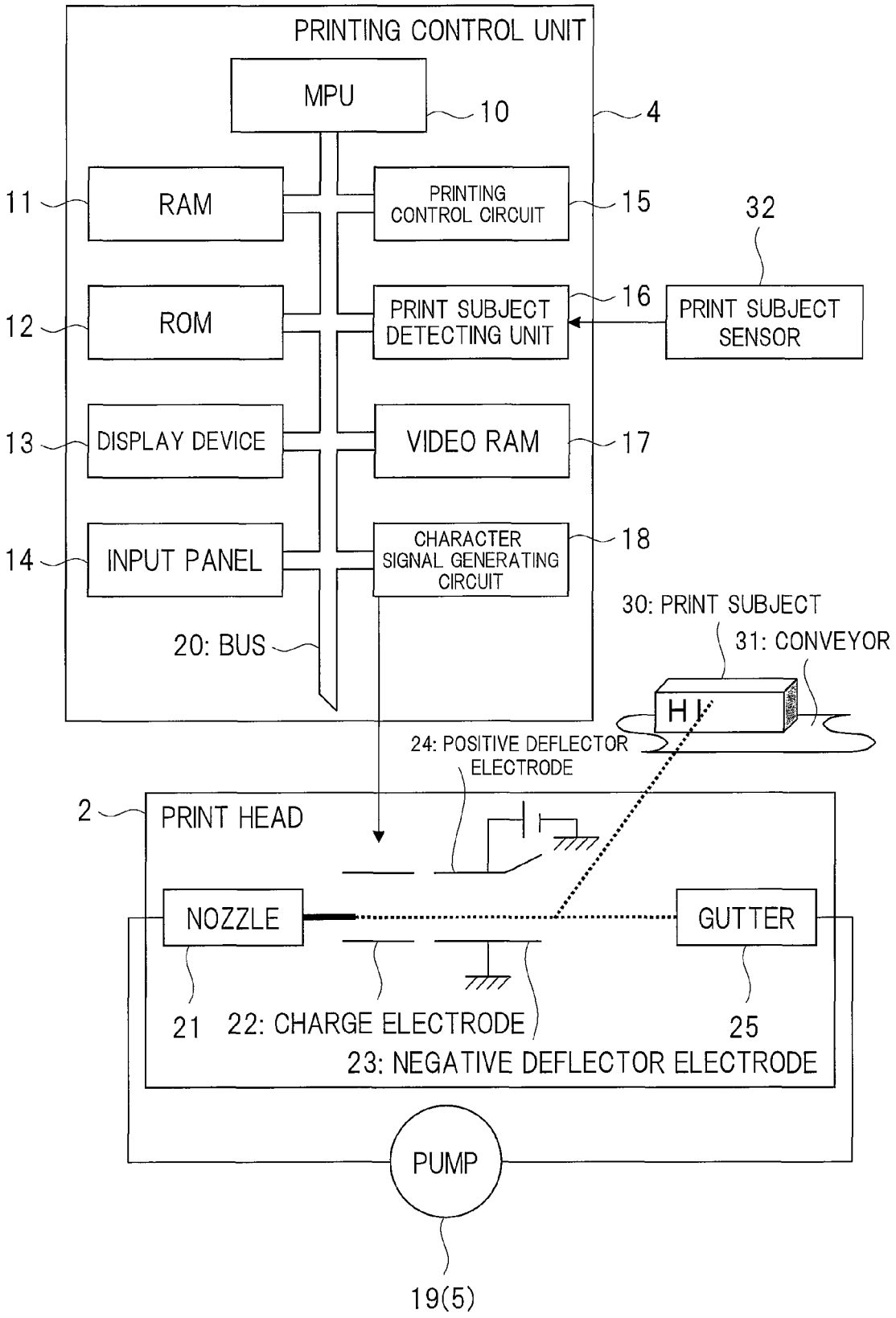
FIG. 2 is an explanatory diagram of an example of a configuration of a body and a printing head of the inkjet recording device of FIG. 1.

The ink jet recording device includes a body 1, a printing head 2, and a cable 3. The body 1 is connected to the printing head 2 via the cable 3. The body 1 includes a printing control unit 4 and a circulation unit 5, which are depicted in FIG. 2 that will be referred to later. The printing head 2 jets print particles, based on a control signal output from the body 1, and performs printing on a print subject, which is a product, etc.

Example of Configuration of Body and Printing Head

FIG. 2 is an explanatory diagram of an example of a configuration of the body and printing head of the inkjet recording device of FIG. 1.

The body 1 includes the printing control unit 4 and the circulation unit 5. The printing control unit 4 has an MPU (Micro Processing Unit) 10 serving as a control unit, a RAM (Random Access Memory) 11 serving as a data storage unit, a ROM (Read Only Memory) 12, a display device 13, an input panel 14, a printing control circuit 15, a print subject detecting circuit 16, a video RAM 17, and a character signal generating circuit 18. Blocks of components making up the printing control unit 4 are interconnected via a bus 20. The circulation unit 5 has a pump 19. The printing head 2 includes a nozzle 21, a charging electrode 22, a negative deflector electrode 23, a positive deflector electrode 24, and a gutter 25.

The MPU 10 supervises a control process carried by the ink jet recording device. The RAM 11 is a volatile memory, temporarily storing data therein. The RAM 12 is a non-volatile memory, storing therein software and data for calculating a writing-start position, etc.

The display device 13 displays input data, print contents, etc. The input panel 14 is an input device on which print contents data, etc., is input. The print contents data is made up of, for example, the width of a print subject, a print distance, a writing-start position, the width of a print character string, a letter height preset value, and letters to be printed. The print distance is distance information indicative of the distance from the printing head 2 to a print subject 30, and the letter height preset value is letter height information indicative of the height of a letter to be printed.

The printing control circuit 15 controls the printing operation of the ink jet recording device. The print subject detecting circuit 16 detects the print subject 30, based on a detection result from a print subject sensor 32.

The video RAM 17 stores therein video data that is charging data according to which print particles are charged. The character signal generating circuit 18 functioning as a charge voltage generator turns print contents to be printed on the print subject 30 into a character signal. The pump 19 supplies ink to the nozzle 21.

The charging electrode 22 applies electric charges to print particles created by granulating ink jet out of the nozzle 21 into particles. The negative deflector electrode 23 and positive deflector electrode 24 deflect charged print particles. The gutter 25 reclaims ink not used for printing.

The gutter 25 is connected to the body 1 via a tube (not depicted), etc. Ink reclaimed by the gutter 25 is stored in an ink container (not depicted) included in the circulation unit 5 of the body 1. The pump 19 supplies ink stored in the ink container to the nozzle 21.

The print subject 30 is placed on a conveyor 31 that transfers the print subject 30. The conveyor 31 is provided with the above print subject sensor 32, which detects the print subject 30.

An outline of a series of actions carried out by the ink jet recording device, the actions ranging from inputting print contents to completing printing, will then be described.

Print contents data is input first using the input panel 14. In this process, the print contents data is input on the input panel 14 according to an input instruction, etc., displayed on the display device 13. The input print contents data is saved by the RAM 11.

The print contents data saved by the RAM 11 is read out therefrom by the MPU 10. Following a program stored in the ROM 12, the MPU 10 creates video data for charging print particles according to the print contents data, and sends the created video data to the video RAM 17 through the bus 20.

Programs stored in the ROM 12 includes a program for applying a non-print charge voltage, i.e., a charge voltage that drives a non-print particle to an extent that it does not fly over the gutter 25, to a non-print particle in a print matrix and a program for applying the non-print charge voltage that drives a non-print particle to an extent that it does not fly over the gutter 25, to a plurality of non-print particles that are flown after the flight of the last print particle.

When the print subject sensor 32 detects the print subject 30, a detection signal is outputs to the print subject detecting circuit 16. Receiving the detection signal, the print subject detecting circuit 16 outputs a print start signal to the MPU 10.

Based on the print start signal, the MPU 10 outputs video data stored in the video RAM 17 to the character signal generating circuit 18 via the bus 20. The character signal generating circuit 18 converts the incoming video data into a charge signal serving as a control signal. The printing control circuit 15 controls timing of outputting the charge signal created out of the video data through the conversion by the character signal generating circuit 18 to the charging electrode 22.

The nozzle 21 is supplied with ink pressurized by the pump 19. An excitation voltage is applied to the nozzle 21, where a signal determined by the frequency of the excitation voltage is applied to ink, causing ink to jet out of the showerhead of the nozzle 21 in the form of an ink pillar.

The ink pillar jet out of the nozzle 21 is granulized in the charging electrode 22 into ink particles, i.e., print particles. Print particles used for printing are charged negatively with negative electric charges and fly through an electric field created by the positive deflector electrode 24 and the negative deflector electrode 23, during which the negatively charged print particles are deflected toward the positive deflector electrode 24. As a result, the print particles fly toward the print subject 30 and deposit thereon to form printed characters.

A print particle with a large charge amount deflects heavily, while a print particle with a small charge amount deflects slightly. A non-print particle, i.e., ink particle not used for printing, is reclaimed by the gutter 25, from which the reclaimed ink particle is resupplied to the nozzle 21 by the pump 19.

The occurrence of bowed printing will be described.

Example of Occurrence of Bowed Printing During Forward Scanning

Figure 3:
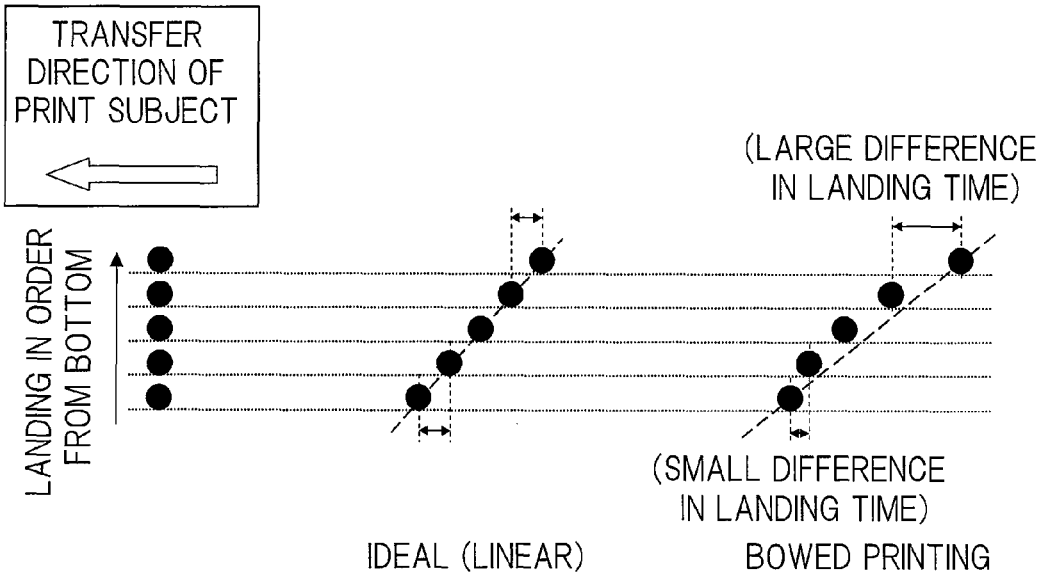
FIG. 3 is an explanatory diagram of an example of occurrence of bowed printing during forward scanning.

FIG. 3 is an explanatory diagram of an example of occurrence of bowed printing during forward scanning. Forward scanning means a scanning process by which print particles ranging from the print particle with the smallest charge amount to the print particle with the largest charge amount are flown in sequence in the order of charge amount increase. FIG. 3 depicts an example in which one vertical column segment is printed using five print particles.

In a case where the print subject is not moving, when the one vertical column segment is printed, a straight column segment with no tilted letter or bowed printing results, as shown on the left in FIG. 3.

A case where the print subject is moving will then be described.

According to the inkjet recording device of FIG. 2, printing is performed as the print subject 30 is moved by the conveyor 31. In the case of forward scanning, print particles with a smaller charge amount, that is, print particles with a shorter flight distance are flown first during the process of sequential flight of print particles. As a result, the resulting column segment tilts as the print subject 30 moves.

In this forward scanning, the print particle subjected to the smallest amount of a charge voltage, that is, print particle with the smallest charge amount is deposited on the print subject first. This print particle, therefore, turns out to be the start-side print particle. The print particle with the largest charge amount, on the other hand, is the print particle that is deposited last on the print subject, and is therefore turns out to be the end-side print particle.

The faster the travel speed of the print subject 30 is, the larger the tilt of the column segment becomes. In this case, if a difference in the landing time between a print particle and another print particle in the vertical column is constant, the printing on a straight line is possible although a printing result is tilted as shown at the center in FIG. 3.

In the case of the printing result shown at the center in FIG. 3, straight vertical printing can be achieved by adjusting the angle of the print head 2 in correspondence to the transfer speed of the print subject 30 and causing print particles to fly in the direction reverse to the transfer direction.

When the landing time differences between the original landing times of print particles making up the vertical column segment and the actual landing times of the same are not constant in proportion to transfer of the print subject, the horizontal travel distances of the print particles are not constant in proportion to transfer of the print subject, which is demonstrated by an equation 1.

$$\text{landing time difference} \times \text{travel speed of print subject} = \text{horizontal travel distance} \quad \text{(equation 1)}$$

This is because that a print particle deflected to a greater extent travels a longer distance from the nozzle 21 to the print subject 30, thus taking a longer time to land on the print subject 30. As a result, as shown in the right in FIG. 3, the printed column segment is bowed. In this case, adjusting the angle of the print head 2 remedies the tilt of the printed column segment but hardly corrects the bowed column segment into straight one.

Figure 4:
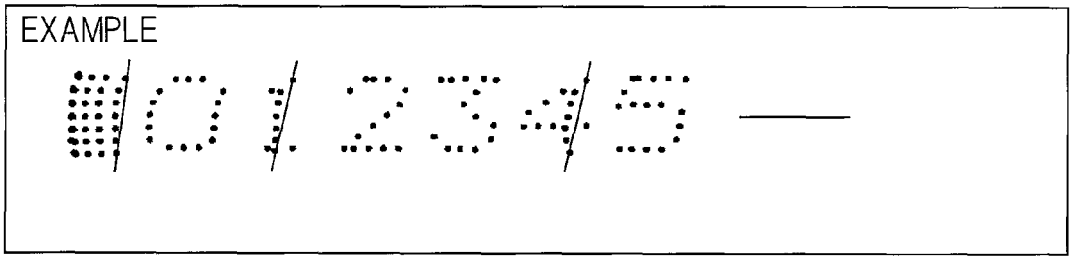
FIG. 4 is an explanatory diagram of an example of a print result in a case where vowed printing occurs when printing is carried out as a print subject is transferred at high speed.

FIG. 4 is an explanatory diagram of an example of a print result in a case where vowed printing occurs when printing is carried out as the print subject is transferred at high speed.

As shown in FIG. 4, when printing is carried out as the print subject is transferred at high speed, if landing time differences between the original landing times of print particles making up one vertical column segment and the actual landing times of the same result, bowed printing occurs.

Example of Occurrence of Bowed Printing During Backward Scanning

Figure 5:
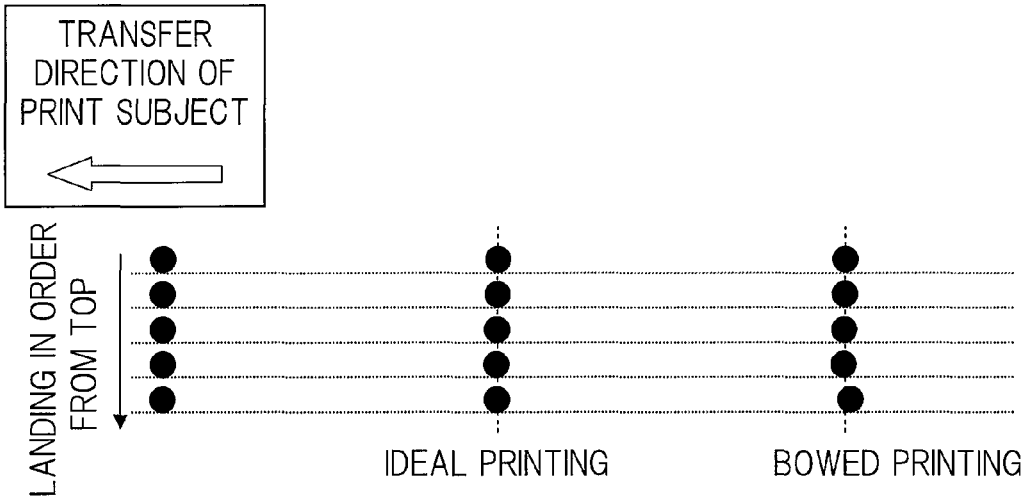
FIG. 5 is an explanatory diagram of an example of occurrence of bowed printing during backward scanning.

FIG. 5 is an explanatory diagram of an example of occurrence of bowed printing during backward scanning. Backward scanning is performed in the direction reverse to the direction of forward scanning, causing print particles ranging from the print particle with the largest charge amount to the print particle with the smallest charge amount to flow in sequence in the order of charge amount decrease. FIG. 5 depicts an example in which one vertical column segment is printed using five print particles.

In this backward scanning, the print particle subjected to the largest amount of a charge voltage, that is, print particle with the largest charge amount is deposited on the print subject first. This print particle, therefore, turns out to be the start-side print particle. The print particle with the smallest charge amount, on the other hand, is the print particle that is deposited last on the print subject, and is therefore turns out to be the end-side print particle.

When the one vertical column segment is printed as the print subject stands still, the same print result as in the case of forward scanning is obtained. As shown in the left in FIG. 5, straight printing with no bowing or tilt results.

A case where the print subject 30 is transferred by the conveyor 31, as shown in FIG. 2, will then be described.

In the case of backward scanning, a print particle with a longer flight distance is flown first in sequential flight of print particles. As a result, the tilt of the print result is remedied significantly, compared to the forward scanning case. If landing time differences between the original landing times of print particles making up the vertical column segment and the actual landing times of the same are constant in proportion to transfer of the print subject, the vertical column segment can be printed along a straight line almost without a tilt, as shown at the center in FIG. 5.

However, in actual printing, the print particle to fly last among the print particles making up the vertical column segment is subjected to a force acting only in the decelerating direction, which force originates from a Coulomb's force between the print particle and a preceding print particle. This causes the print particle to delay in landing on the print subject, thus causing the print particle to land on a spot shifted rightward, as shown in the right in FIG. 5.

Figure 6:
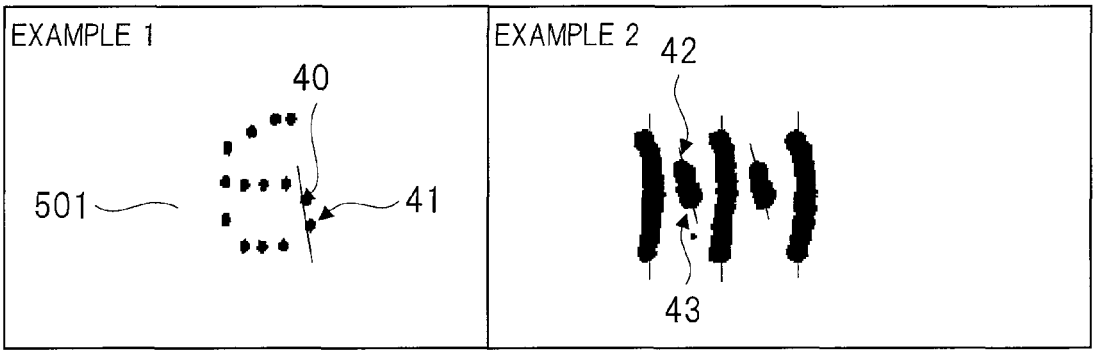
FIG. 6 is an explanatory diagram of an example of a print result in a case where vowed printing occurs when printing is carried out through backward scanning.

FIG. 6 is an explanatory diagram of an example of a print result in a case where vowed printing occurs when printing is carried out through backward scanning.

A first example shown in the left in FIG. 6 demonstrates a case where a print particle 40 is decelerated by heavy air resistance, moves closer to a print particle 41, where the print particle 40 is subjected to Coulomb's repulsion that accelerates the print particle 40, and consequently lands on a spot shifted leftward at a time earlier than the original landing time. In this case, the print particle 40 accelerated by the Coulomb's repulsion shifts leftward while the print particle 41 decelerated by the Coulomb's repulsion shifts rightward, that is, delays in landing. Bowed printing, therefore, results.

A second example shown in the right in FIG. 6 is described as the following case. A print particle 42 that flies after the flight of a preceding vertical column of print particles is subjected to reduced air resistance and is therefore hardly decelerated. A Coulomb's force between the print particle 42 and an ensuing print particle acts on the print particle 42 in the accelerating direction and therefore tends to shift the print particle 42 leftward. A print particle 43 is subjected to Coulomb's repulsion from a preceding print particle that acts only in the decelerating direction, and therefore delays in landing, that is, shifts rightward. As a result, these particles end up in forming an unevenly tilted column, as shown in the second example.

<Suppressing Bowed Printing>

A technique for suppressing bowed printing that is applied to the ink jet recording device of FIG. 2 will hereinafter be described.

Figure 7:
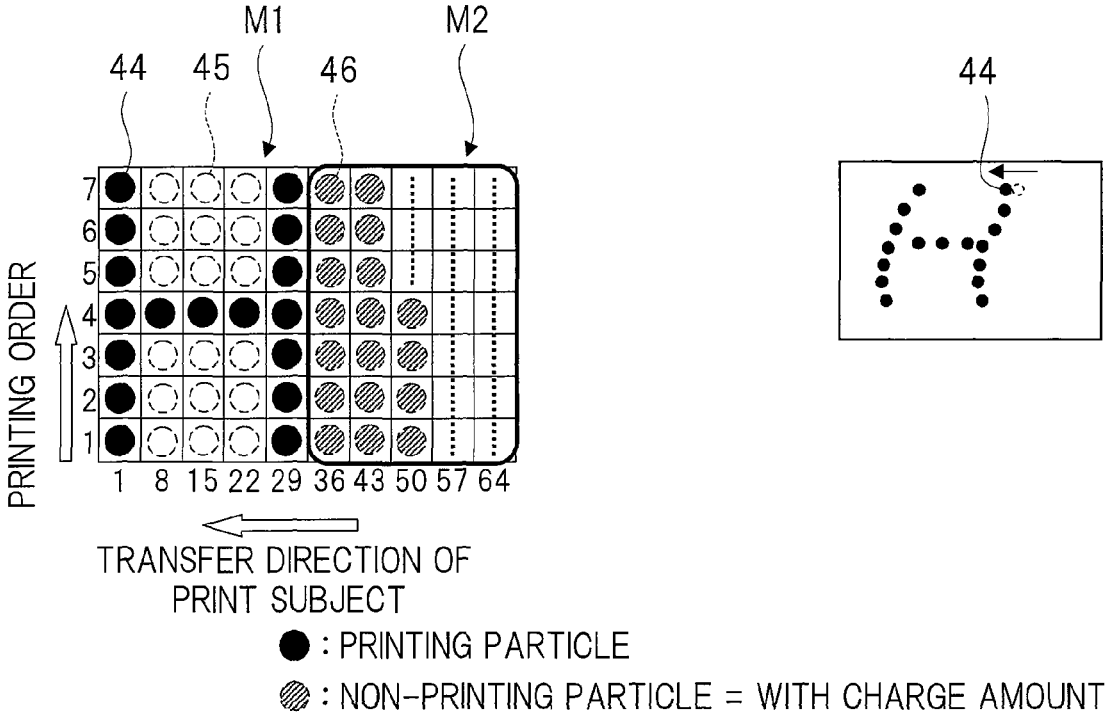
FIG. 7 is an explanatory diagram of an example of printing performed by the ink jet recording device of FIG. 2.
Figure 8:
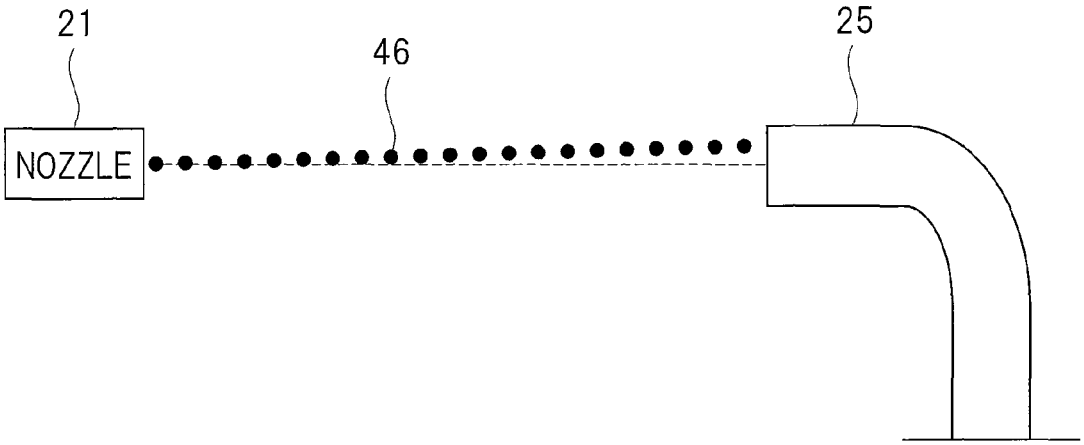
FIG. 8 is an explanatory diagram of an example of the flight of a non-print particle that results during the printing process of FIG. 7.

FIG. 7 is an explanatory diagram of an example of printing performed by the ink jet recording device of FIG. 2. FIG. 8 is an explanatory diagram of an example of the flight of a non-print particle charged to an extent that it does not fly over the gutter.

FIG. 7 depicts a case where an alphabetical letter "H" is printed on a print matrix M1 of a 5 (row) by 7 (column) font size. The print matrix M1 represents the last letter printed on the print subject. A print matrix M2 indicated on the right of the print matrix M1 by a thick line is a print matrix not used for printing.

In the print matrix M1, black circles represent print particles 44 while circles drawn by dotted lines represent non-print particles 45 not used for printing. In the print matrix M2, circles drawn by dotted lines represent non-print particles 46 not used for printing.

Printing is performed in the following order. First, one vertical column located at the left end of the print matrix M1 of FIG. 7 is printed by landing a column of print particles on the print subject in sequence in bottom-to-top order. When printing of this vertical column is over, another vertical column located on the right of the printed vertical column is printed by landing a column of print particles on the print subject in sequence in bottom-to-top order. These processes are repeated to perform printing on the print matrix of the 5 by 7 font size. Numbers arranged along sides of the matrixes M1 and M2 in FIG. 7 represent an order of printing.

When the letter "H" is printed, no letter is printed on the print matrix M2 after the flight of the print particle 44 that lands last on the print matrix M1. The non-print particle 46, therefore, is jetted out of the nozzle 21 after the flight of the print particle 44. At this time, as shown in FIG. 7, the printing control unit 4 performs control so that a non-print charge voltage is applied to the non-print particle 46.

To the non-print particle 46 that is flown after the flight of the last print particle 44 for printing the letter "H", for example, the non-print charge voltage driving the non-print particle 46 to an extent that it does not fly over the gutter 25 is applied, as shown in FIG. 8. This non-print charge voltage minutely deflects the non-print particle 46. In FIG. 7, the hatched non-print particles 46 in the print matrix M2 represent the non-print particles 46 that are subjected to the non-print charge voltage driving the non-print particles 46 to an extent that they do not fly over the gutter 25.

In this process, following a program stored in the ROM 12, the MPU 10 generates video data for charging print particles, according to print contents data stored in the RAM 11.

The MPU 10 detects the letter to be printed last, based on the print contents data. When printing of the letter to be printed last is over, that is, when the print operation on the print matrix M1 is ended, the MPU 10 generates video data so that based on the generated video data, the non-print charge voltage driving non-print particles to an extent that they do not fly over the gutter 25 is applied to the non-print particles making up the next matrix M2. The number of non-print particles subjected to the non-print charge voltage driving the non-print particles to an extent that they do not fly over the gutter 25 is one or more, preferably, 15 or more.

The number of non-print particles subjected to the non-print charge voltage driving the non-print particles to an extent that they do not fly over the gutter 25 may be determined in advance, or may be determined by the MPU 10, based on the print contents data. For example, the ROM 12 keeps data based on which the optimum number of the non-print particles 46 to be subjected to the non-print charge voltage is determined according to the print contents data. Based on the print contents data, therefore, the MPU 10 searches the ROM 12 and determines the number of the non-print particles 46 to be subjected to the non-print charge voltage.

In another case, following a program stored in the ROM 12, the MPU 10 may calculate the number of the non-print particles 46 to be subjected to the non-print charge voltage, based on the print contents data stored in the RAM 11.

As described above, the print contents data includes the distance from the print head 2 to the print subject 30, the letter height preset value, and print speed information indicative of the travel speed of the print subject. The longer distance from the print head 2 to the print subject 30 or the larger letter height leads to a print result of a larger size.

In the case of a print result of a larger size, print particles must be deflected widely, in which case the charge amount is increased, resulting in a larger effect of a Coulomb's force. This leads to a collusion that the larger the size of the print result is, the greater the number of the non-print particles 46 subjected to the non-print charge voltage driving the non-print particles 46 to an extent that they do not fly over the gutter 25 becomes. Hence, by charging the non-print particles 46 in this manner, bowed printing described referring to FIG. 3 can be suppressed.

An effect achieved by charging the non-print particles 46 will be described, referring to the print result shown in the right in FIG. 3. As described above, the print result shown in the right in FIG. 3 indicates the result of flying print particles in sequence in bottom-to-top order, in which case the last print particle at the top is shifted rightward.

In FIG. 3, the last print particle is subjected to a Coulomb's force from a preceding print particle having flown right before. Since no printing is performed on the matrix M2, no print particle is present behind the last print particle having flown last. For this reason, the last print particle is subjected to a force acting only in the decelerating direction and consequently delays in landing on the print subject. The print subject 30 moves during the delay in landing by the last print particle, which widely shifts the print particle's landing position rightward.

When printing on the print matrix M1 is over and the print matrix M2 on which no printing is performed follows, the non-print charge voltage is applied to the non-print particles 46 jetted out of the nozzle 21 to provide a charged non-print particle, i.e., charged non-print particle 46, behind the last print particle, where no print particle is present. As a result, a Coulomb's force between the charged non-print particle 46 and the last print particle suppresses the force acting on the last print particle only in the decelerating direction. Hence the amount of rightward shift of the last print particle is reduced.

Suppression of bowed printing resulting from forward scanning is described above. The same effect of bowed printing suppression is achieved also in the case of backward scanning that is described referring to FIG. 5. By this effect, the Coulomb's force acting in a single direction on the last-flying print particle in the print matrix is reduced, which suppress a rightward shift of the print particle. In the case of FIG. 5, the print particle at the bottom flies last when backward scanning is performed.

Example of Printing Examined by the Inventors

Figure 9:
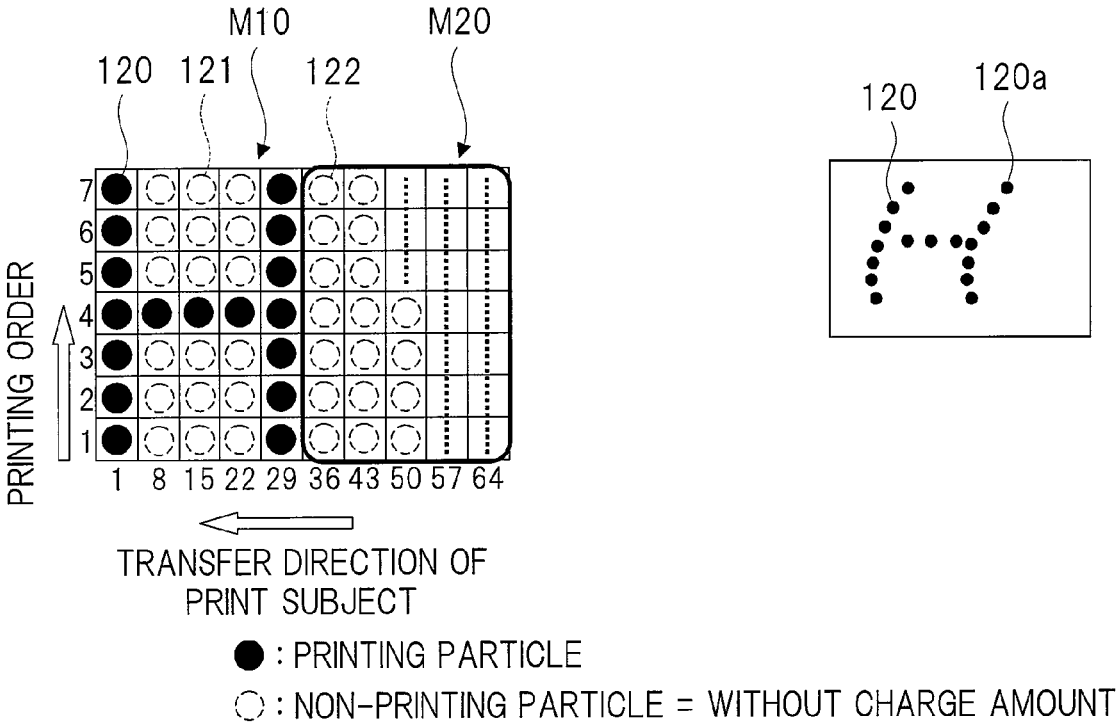
FIG. 9 is an explanatory diagram of an example of printing by the ink jet recording device that is examined by the inventors of the present invention.
Figure 10:
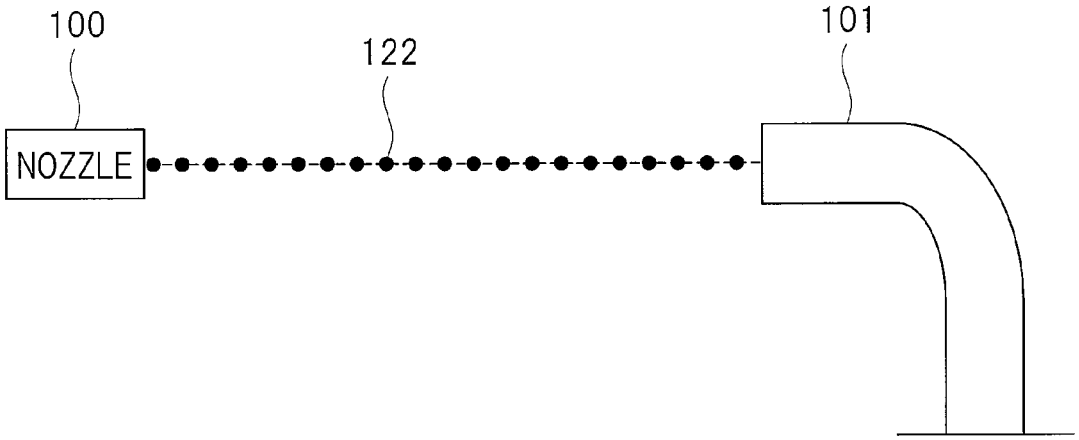
FIG. 10 is an explanatory diagram of an example of the flight of a non-print particle that results during the printing process of FIG. 9.

FIG. 9 is an explanatory diagram of an example of printing by the ink jet recording device that is examined by the inventors of the present invention. FIG. 10 is an explanatory diagram of an example of the flight of a non-print particle that results during the printing process of FIG. 9.

FIG. 9 depicts a case similar to the case of FIG. 7 where an alphabetical letter "H" is printed on a print matrix M10 of a 5 by 7 font size. A print matrix M20 indicated on the right of the print matrix M10 by a thick line is a print matrix not used for printing.

In the print matrix M10, black circles represent print particles 120 while circles drawn by dotted lines represent non-print particles 121 not used for printing. In the print matrix M20, circles drawn by dotted lines represent non-print particles 122 not used for printing. The order of printing of FIG. 9 is the same as that of FIG. 7 and therefore is not described repeatedly.

When the letter "H" is printed, a nozzle 100 jets out the last print particle 120 that flies to land last on the print subject. Since no printing is performed on the print matrix 20 following the print matrix M10, the non-print particle 122 is jetted out of the nozzle 100 after the flight of the last print particle 120.

In this case, no charge voltage is applied to the non-print particle 122, whose charge amount is, therefore, 0 [C (Coulomb)]. As a result, the non-print particle 122 jetted out of the nozzle 100 passes through the center of a gutter 101. In some cases, a charge voltage may be applied to the non-print particle that follows the last print particle. In such a case, however, the charge voltage is applied to the non-print particle for the purpose of preventing charging of the non-print particle.

In this manner, when no charge voltage is applied to the non-print particle 122, the last-flying print particle is subjected to the force acting only in the decelerating direction, in which case, as shown on the right in FIG. 9, the last-flying print particle 120*a* among the print particles 120 delays in landing and is therefore widely shifted rightward.

In the case of FIG. 7 where the non-print charge voltage is applied to the non-print particle 46, the Coulomb's force between the non-print particle 46 and the last print particle 44 suppresses the force acting only in the decelerating direction. Hence the amount of rightward shift of the last print particle 44 is reduced, as shown in on the right in FIG. 7.

Through the above processes, the quality irregularity of print results is reduced. The sound quality of print results reduces cases where despite proper printing performance, a printing inspection apparatus fails to recognize printed characters, letters, etc., and detects them to be a print failure, instead. As a result, productivity in manufacturing products, i.e., print subjects, is improved.

Second Embodiments

According to the first embodiment, following the end of printing on the print matrix where the last letter is printed, the non-print charge voltage is applied to the non-print particle of the print matrix on which no printing is performed. A second embodiment relates to an example in which a pattern of applying a non-print charge voltage to non-print particles is different from the pattern of non-print charge voltage application of the first embodiment.

A configuration of the ink jet recording device of the second embodiment is the same as the configuration of the ink jet recording device of the first embodiment shown in FIGS. 1 and 2. Control over application of the non-print charge voltage to print particles during the print operation to be described below is carried out by the printing control unit 4 in the same manner as in the first embodiment.

At the printing control unit 4, following a program stored in the ROM 12, the MPU 10 creates video data for charging print particles according to print contents data, and sends the created video data to the video RAM 17 through the bus 20. The character signal generating circuit 18 generates a charge voltage applied to the print particles and a non-print charge voltage applied to non-print particles, based on the video data stored in the video RAM 17.

Example of Suppression of Bowed Printing

Figure 11:
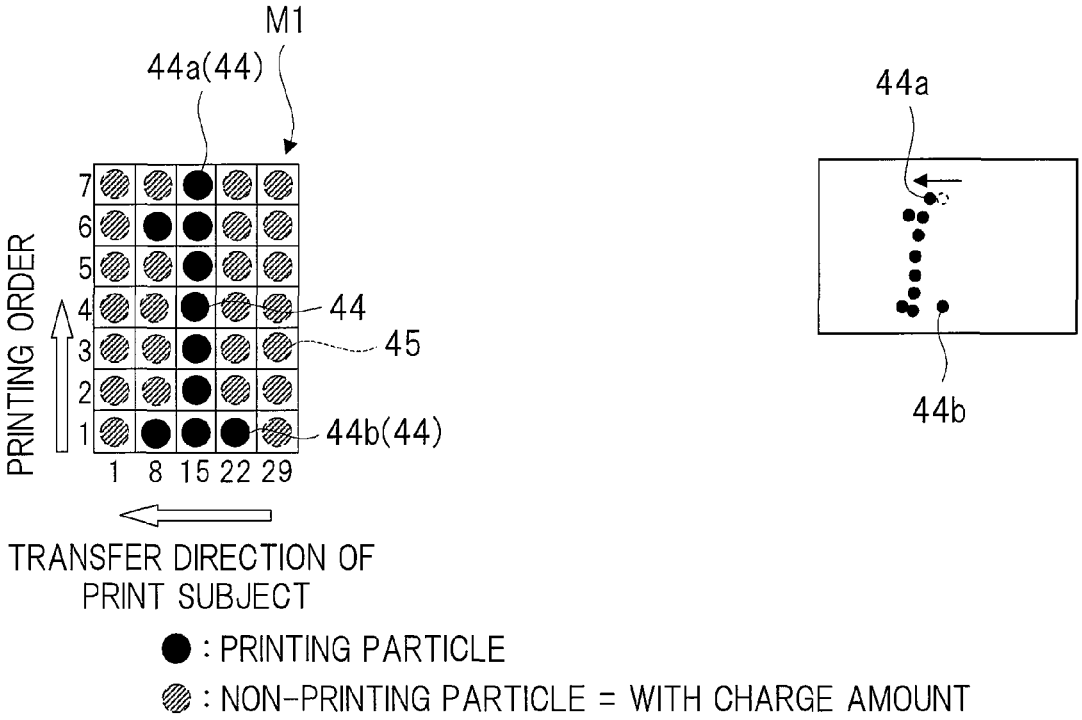
FIG. 11 is an explanatory diagram of an example of printing by an ink jet recording device according to a second embodiment of the present invention.
Figure 12:
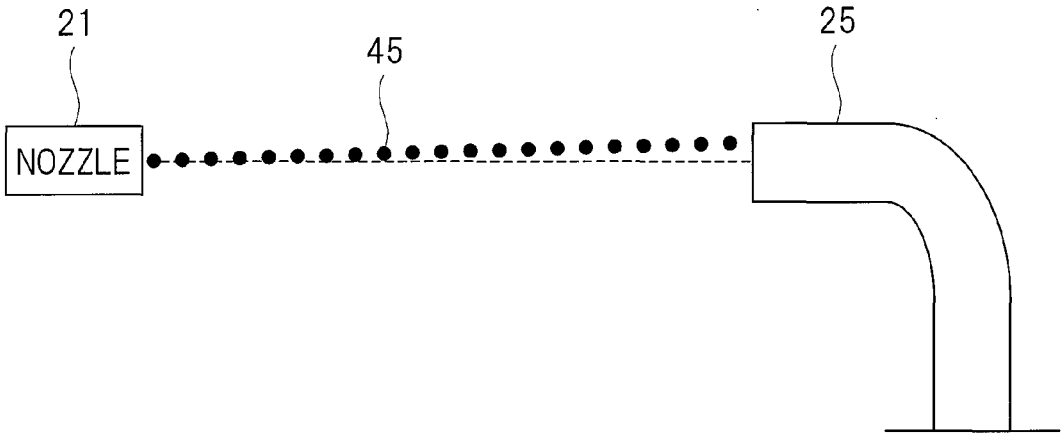
FIG. 12 is an explanatory diagram of an example of the flight of a non-print particle that results during the printing process of FIG. 11.

FIG. 11 is an explanatory diagram of an example of printing by the ink jet recording device according to the second embodiment of the present invention, and FIG. 12 is an explanatory diagram showing the flight of a non-print particle that is charged to an extent that it does not fly over the gutter in the printing example of FIG. 11.

FIG. 11 depicts a case where a figure "1" is printed on the print matrix M1 of the 5 by 7 font size. In the print matrix M1, black circles represent print particles 44 while circles drawn by dotted lines represent non-print particles 45 not used for printing. Order of printing on the print matrix M1 is the same as the case of FIG. 7.

According to the first embodiment depicted in FIG. 7, following the end of printing on the print matrix M1 where the last letter is printed, the non-print charge voltage is applied to the non-print particle 46. According to the case of FIG. 11, when the figure "1" is printed, the non-print charge voltage is applied to all the non-print particles 45 included in the print matrix M1.

To the non-print particle 45 of the print matrix M1, for example, the non-print charge voltage driving the non-print particle 45 to an extent that it does not fly over the gutter 25 is applied, as shown in FIG. 12. This non-print charge voltage minutely deflects the non-print particle 45. In FIG. 11, the hatched non-print particles 45 represent the non-print particles that are subjected to the non-print charge voltage driving the non-print particles to an extent that they do not fly over the gutter 25.

In this case, the same principle of bowed printing suppression as described in the first embodiment depicted in FIG. 7 works such that the Coulomb's force between the print particle 44 and the non-print particle 45 following it suppresses the force acting only in the decelerating direction.

Example of Printing Examined by the Inventors

Figure 13:
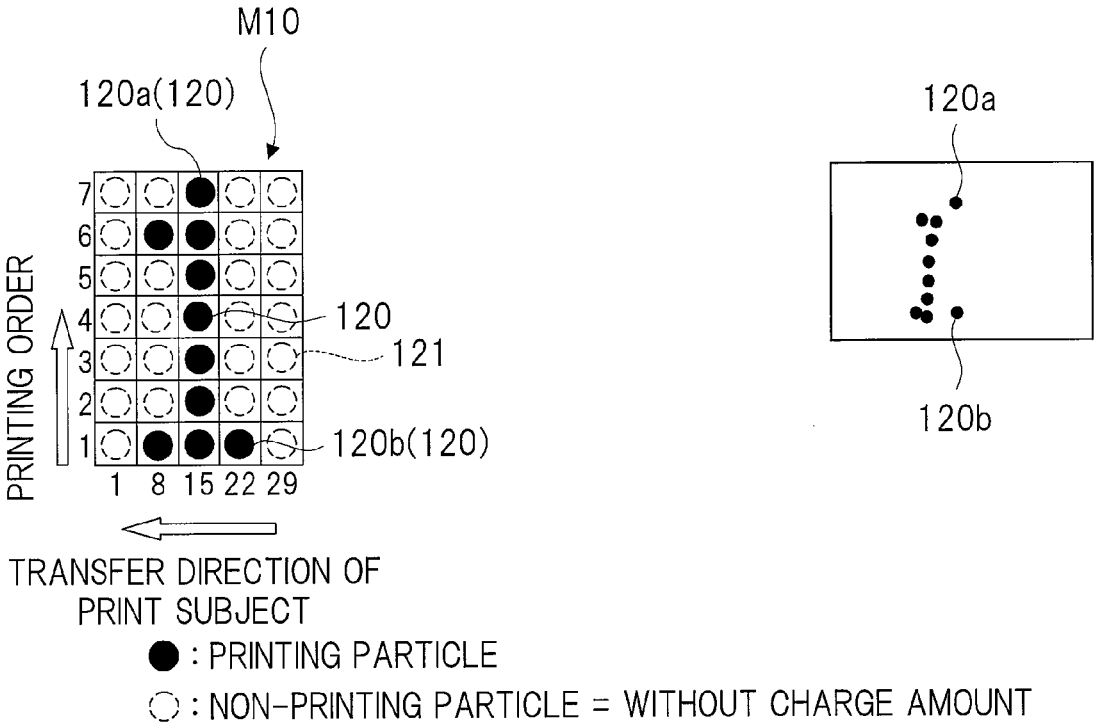
FIG. 13 is an explanatory diagram of an example of printing by the ink jet recording device that is examined by the inventors of the present invention.
Figure 14:
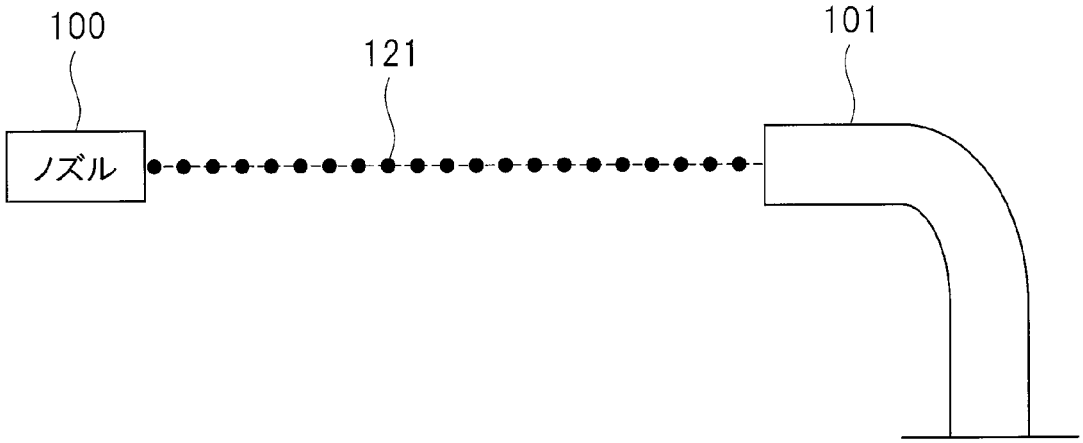
FIG. 14 is an explanatory diagram of an example of the flight of a non-print particle that results during the printing process of FIG. 13.

FIG. 13 is an explanatory diagram of an example of printing by the ink jet recording device that is examined by the inventors, and FIG. 14 is an explanatory diagram showing the flight of a non-print particle of a print matrix depicted in the printing example of FIG. 13.

FIG. 13 depicts a case similar to the case of FIG. 11 where the figure "1" is printed on the print matrix M10 of the 5 by 7 font size. In the print matrix M10, black circles represent the print particles 120 while circles drawn by dotted lines represent the non-print particles 121 not used for printing. The order of printing of FIG. 13 is the same as that of FIG. 11 and therefore is not described repeatedly.

As shown in FIG. 13, a charge voltage is applied to the print particles 120 used for printing the figure "1" and is not applied to the non-print particles 121 not used for printing on the matrix M10. The non-print particle 121, therefore, has zero charge amount, i.e., 0 [C (Coulomb)], which causes the non-print particle 121 to pass through the center of the gutter 101 to be reclaimed.

In this manner, when no non-print charge voltage is applied to the non-print particle 121, among the print particles 120, the 21-th print particle 120*a* and 22-th print particle 120*b* not followed by a print particle subjected to the charge voltage are subjected to a force acting only in the decelerating direction, in which case, as shown on the right in FIG. 13, the last-flying print particles 120*a* and 120*b* delay in landing and are therefore widely shifted rightward.

When the non-print charge voltage is applied to all the non-print particles 45 in the print matrix M1, the force acting only in the decelerating direction is suppressed by a Coulomb's force between the print particle 44 and the non-print particle 45. As a result, as shown on the right in FIG. 11, the amount of rightward shift of print particles 44*a* and 44*b*, behind which a print particle subjected to the charge voltage is not present, is reduced.

In the above manner, the quality irregularity of print results is reduced. The stable quality of print results improves the precision of a print inspection.

Third Embodiment

According to third embodiment, when a charge voltage is applied consecutively to two or more print particles during printing on a print matrix, a non-print charge voltage is applied to a non-print particle present between the print particle that is subjected last to the charge voltage and the print particle to be subjected next to the charge voltage.

A configuration of the ink jet recording device of the third embodiment is the same as the configuration of the ink jet recording device of the first embodiment shown in FIGS. 1 and 2. Control over application of a charge voltage to print particles and of a non-print charge voltage to non-print particles during the print operation to be described below is carried out by the printing control unit 4 in the same manner as in the first embodiment.

At the printing control unit 4, following a program stored in the ROM 12, the MPU 10 creates video data for charging print particles according to print contents data, and sends the created video data to the video RAM 17 through the bus 20. The character signal generating circuit 18 generates a charge voltage applied to the print particles and a non-print charge voltage applied to non-print particles, based on the video data stored in the video RAM 17.

Example of Suppression of Bowed Printing

Figure 15:
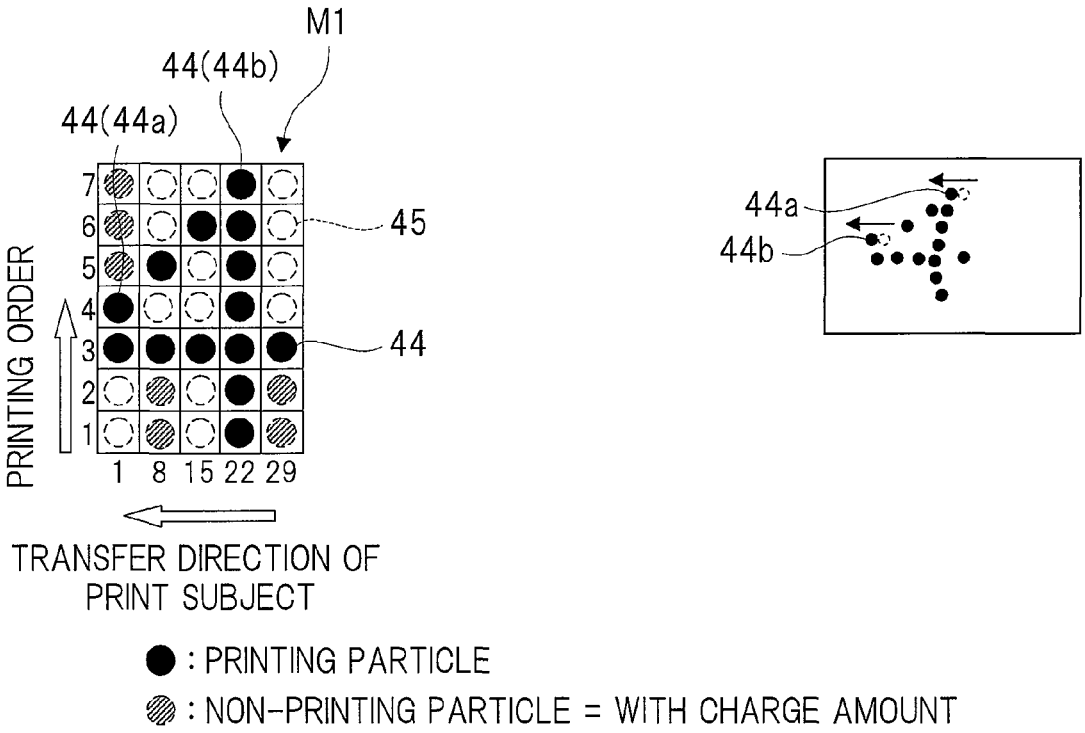
FIG. 15 is an explanatory diagram of an example of printing by an ink jet recording device according to a third embodiment of the present invention.
Figure 16:
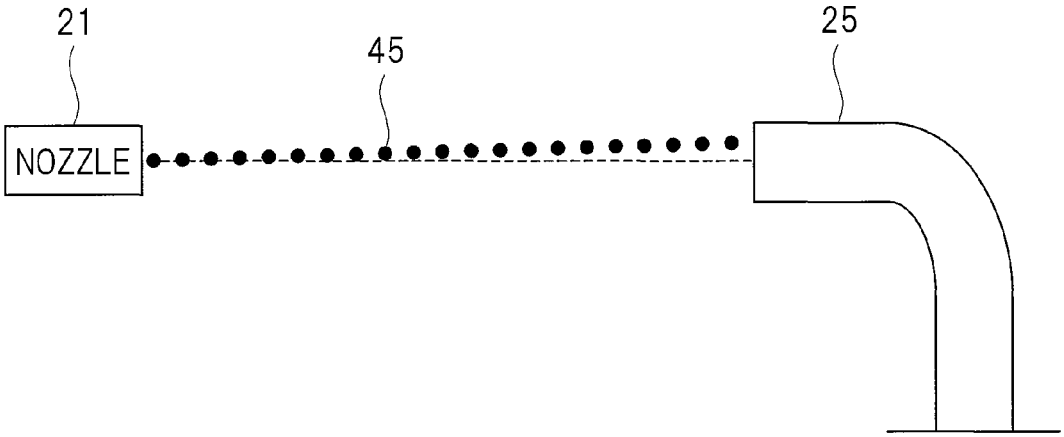
FIG. 16 is an explanatory diagram of an example of the flight of a non-print particle that results during the printing process of FIG. 15.

FIG. 15 is an explanatory diagram of an example of printing by the ink jet recording device according to the third embodiment, and FIG. 16 is an explanatory diagram showing an example of the flight of a non-print particle charged to an extent that it does not fly over the gutter in the printing example of FIG. 15.

FIG. 15 depicts a case where a figure "4" is printed, for example, on the print matrix M1 of the 5 by 7 font size. In the print matrix M1, black circles represent print particles 44 while circles drawn by dotted lines represent non-print particles 45 not used for printing. Order of printing on the print matrix M1 is the same as the case of FIG. 7.

When the figure "4" is printed, in FIG. 15, attention is paid to the first vertical column located on the left end of the print matrix M1 and the second vertical column on the right of the first vertical column.

The first vertical column includes the first, second, and fifth to seventh non-print particles 45, and the third and fourth print particles 44. The second vertical column includes the eighth, ninth, 11-th, 13-th, and 14-th non-print particles 45, and the tenth and 12-th print particles 44.

As mentioned above, when the charge voltage is applied consecutively two or more print particles, the non-print charge voltage is applied to a non-print particle present between the print particle that is subjected last to the charge voltage and the print particle to be subjected next to the charge voltage.

At the first vertical column, the charge voltage is applied consecutively to the third and fourth print particles 44. The non-print charge voltage is, therefore, applied to the fifth to ninth non-print particles 45 present between the fourth print particle 44 of the first vertical column and the tenth print particle 44 of the second vertical column that is to be subjected next to the charge voltage.

At this time, the non-print charge voltage applied to the non-print particles 45 of the matrix M1 is determined to be the non-print charge voltage that drives the non-print particles 45 to an extent that they do not fly over the gutter 25, as shown in FIG. 16, so that the non-print particles 45 are deflected minutely. The hatched non-print particles 45 of FIG. 15 represent the non-print particles 45 subjected to the non-print charge voltage that drives the non-print particles 45 to the extent that they do not fly over the gutter 25.

In the above manner, when the charge voltage is applied consecutively to two or more print particles 44, application of the non-print charge voltage is controlled such that the non-print charge voltage is applied to a non-print particle 45 present between the print particle 44 that is subjected last to the charge voltage and the print particle 44 to be subjected next to the charge voltage.

To carry out this control, following a program stored in the ROM 12, the MPU 10 generates video data for charging the print particles according to print contents data stored in the RAM 11.

Based on the print contents data, when the charge voltage is applied consecutively two or more print particles, the MPU 10 detects a non-print particle present between the print particle that is subjected last to the charge voltage and the print particle to be subjected next to the charge voltage, and generates the video data so that according to the video data, the non-print charge voltage driving the non-print particle to an extent that it does not fly over the gutter 25 is applied to the detected non-print particle.

The number of non-print particles subjected to the non-print charge voltage driving the non-print particles to an extent that they do not fly over the gutter 25 is determined by the MPU 10, based on the print contents data. The ROM 12 keeps data based on which the optimum number of the non-print particles 46 to be subjected to the non-print charge voltage is determined according to the print contents data. Based on the print contents data, therefore, the MPU 10 searches the ROM 12 and determines the number of the non-print particles 46 to be subjected to the non-print charge voltage.

In another case, following a program stored in the ROM 12, the MPU 10 may calculate the number of the non-print particles 46 to be subjected to the non-print charge voltage, based on the print contents data stored in the RAM 11.

As described above, the print contents data includes the distance from the print head 2 to the print subject 30 and the letter height preset value. The longer distance from the print head 2 to the print subject 30 or the larger letter height leads to a print result of a larger size.

In the case of a print result of a larger size, print particles must be deflected widely, in which case the charge amount is increased, resulting in a larger effect of a Coulomb's force. This leads to a collusion that the larger the size of the print result is, the greater the number of the non-print particles 46 subjected to the non-print charge voltage driving the non-print particles 46 to an extent that they do not fly over the gutter 25 becomes.

In the above manner, behind the print particle 44 where another print particle subjected to the charge voltage is not present anymore, a non-print particle subjected to the non-print charge voltage follows the print particle 44. As a result, the force acting on the print particle 44 only in the decelerating direction is suppressed by a Coulomb's force between the print particle 44 and the non-print particle. Hence, as shown on the right in FIG. 15, the amount of rightward shift of the print particles 44*a* and 44*b* is reduced.

The above processes reduce the quality irregularity of print results. The sound quality of print results improves the precision of a print inspection.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention is not limited to the above-described embodiments but includes various modifications. For example, the above-described embodiments have been described in detail to facilitate understanding of the present invention and are not limited to an embodiment including all the constituent elements described above.

A constituent element of an embodiment may be replaced with a constituent element of another embodiment. A constituent element of an embodiment may additionally include a constituent element of another embodiment. A constituent element of each embodiment may additionally include another constituent element, may be deleted, or may be replaced with a different constituent element.

EXPLANATION OF REFERENCE NUMERALS

1 Body
2 Print head
3 Cable
4 Printing control unit
5 Circulation unit
10 MPU
11 RAM
12 ROM
13 Display device
14 Input panel
15 Printing control circuit
16 Print subject detecting circuit
17 Video RAM

18 Character signal generating circuit
19 Pump
20 Bus
21 Nozzle
22 Charging electrode
23 Negative deflector electrode
24 Positive deflector electrode
25 Gutter
30 Print subject
31 Conveyor
32 Print subject sensor
40 Print particle
41 Print particle
42 Print particle
43 Print particle
44 Print particle
44*a* Print particle
44*b* Print particle
45 Non-print particle
46 Non-print particle
M1 Print matrix
M2 Print matrix
100 Nozzle
101 Gutter
120 Print particle
120*a* Print particle
120*b* Print particle
121 Non-print particle
122 Non-print particle
M10 Print matrix
M20 Print matrix

The invention claimed is:

1. An ink jet recording device comprising:

a print head including:

a nozzle that excites ink to jet it in a form of ink particles;

a charging electrode that charges the ink particles;

a deflector electrode that generates an electric field by which the charged ink particles are deflected; and a gutter that captures and reclaims an ink particle not used for printing; and a printing control unit that controls a voltage applied to the charging electrode, wherein the printing control unit causes the charging electrode to apply a charge voltage to a print particle that is an ink particle to be landed on a print subject, and to apply a non-print charge voltage to a non-print particle that is an ink particle not to be landed on the print subject, the non-print charge voltage being a charge voltage driving the non-print particle to an extent that it does not fly over the gutter and having a polarity identical to that of the print particle to be landed on the print subject, so that bowed printing during high-speed printing is suppressed, and when the charge voltage is applied consecutively to two or more of the print particles, the printing control unit applies the non-print charge voltage to the non-print particle being present between the print particle subjected to the charge voltage last among the two or more of print particles and a print particle to be subjected to the charge voltage next.

2. The ink jet recording device according to claim 1, wherein the printing control unit applies the non-print charge voltage to all of the non-print particles during execution of printing.

3. The ink jet recording device according to claim 1, wherein the printing control unit includes:

a data storage unit that stores therein print contents data indicative of data of print contents to be printed out;

a control unit that, according to the print contents data stored in the data storage unit, generates charge data for applying the charge voltage to the print particle and applying the non-print charge voltage to the non-print particle; and a charge voltage generator that, based on the charge data, generates the charge voltage or non-print charge voltage and that supplies the generated charge voltage or non-print charge voltage to the charging electrode, wherein, based on the print contents data, the control unit generates the charge data so that the number of the non-print particles subjected to the non-print charge voltage is changed.

4. The ink jet recording device according to claim 3, wherein print contents data stored in the data storage unit includes distance information indicative of a distance from the print head to the print subject, letter height information indicative of a height of a letter to be printed, and print speed information indicative of a speed with which the print subject moves, and wherein the control unit changes the number of the non-print particles, based on the distance information, the letter height information, and the print speed information.

5. The ink jet recording device according to claim 3, wherein print contents data stored in the data storage unit includes information of the number of non-print particles, the information indicating the number of the non-print particles that can be set arbitrarily, and wherein the control unit changes the number of the non-print particles according to the information of the number of non-print particles.

6. The ink jet recording device according to claim 1, wherein the printing control unit applies the non-print charge voltage to the non-print particle right after end of all printings on the print subject.

7. The ink jet recording device according to claim 6, wherein the printing control unit includes:

a data storage unit that stores therein print contents data indicative of data of print contents to be printed out;

a control unit that, according to the print contents data stored in the data storage unit, generates charge data for applying the charge voltage to the print particle and applying the non-print charge voltage to the non-print particle; and a charge voltage generator that, based on the charge data, generates the charge voltage or non-print charge voltage and that supplies the generated charge voltage or non-print charge voltage to the charging electrode, wherein, based on the print contents data, the control unit changes the number of the non-print particles subjected to the non-print charge voltage for each end of printing on the print subject.

8. The ink jet recording device according to claim 7, wherein print contents data stored in the data storage unit includes distance information indicative of a distance from the print head to the print subject, letter height information indicative of a height of a letter to be printed, and print speed information indicative of a speed with which the print subject moves, and wherein the control unit changes the number of the non-print particles, based on the distance information, the letter height information, and the print speed information.

9. The ink jet recording device according to claim 7, wherein print contents data stored in the data storage unit includes information of the number of non-print particles, the information indicating the number of the non-print particles that can be set arbitrarily, and wherein the control unit changes the number of the non-print particles according to the information of the number of non-print particles.

10. The ink jet recording device according to claim 1, wherein the printing control unit controls the print head so as to provide an amount of a charge voltage applied to the start-side print particle to be the minimum, to gradually increase an amount of application of the charge voltage, and to provide an amount of the charge voltage applied to the end-side print particle to be the maximum.

11. The ink jet recording device according to claim 1, wherein the printing control unit controls the print head so as to provide an amount of a charge voltage applied to the start-side print particle to be the maximum, to gradually decrease an amount of application of the charge voltage, and to provide an amount of the charge voltage applied to the end-side print particle to be the minimum.

* * * * *